US009574370B2

(12) United States Patent
Presti

(10) Patent No.: US 9,574,370 B2
(45) Date of Patent: Feb. 21, 2017

(54) MODULAR PRIVACY FENCE WITH INDIVIDUALLY REPLACEABLE PICKETS

(71) Applicant: Kelly Presti, Fairview, TX (US)

(72) Inventor: Kelly Presti, Fairview, TX (US)

( * ) Notice: Subject to any disclaimer, the term of this patent is extended or adjusted under 35 U.S.C. 154(b) by 0 days.

(21) Appl. No.: 14/627,685

(22) Filed: Feb. 20, 2015

(65) Prior Publication Data

US 2016/0244992 A1 Aug. 25, 2016

(51) Int. Cl.
*E04H 17/14* (2006.01)

(52) U.S. Cl.
CPC ..... *E04H 17/1421* (2013.01); *E04H 17/1417* (2013.01); *E04H 17/1439* (2013.01); *E04H 17/1443* (2013.01); *E04H 2017/1473* (2013.01)

(58) Field of Classification Search
CPC ..... E04H 17/1417; E04H 17/1421; E04H 17/1426; E04H 17/143; E04H 17/1439; E04H 17/1434; E04H 17/1443; E04H 2017/1447; E04H 2017/1473; E04H 2017/1491
See application file for complete search history.

(56) References Cited

U.S. PATENT DOCUMENTS 282,180 A * 7/1883 Erb ..... E04H 17/1443 256/22
792,393 A * 6/1905 Brust ..... E04H 17/1443 256/22
1,719,360 A 7/1929 Deike
2,588,147 A * 3/1952 Morris ..... E04H 17/003 256/73
2,760,759 A 8/1956 Rice
2,919,032 A 12/1959 Sinawski
2,958,422 A 11/1960 Caloiero et al.
3,095,184 A 6/1963 Boxberger
3,218,036 A 11/1965 Kozub
3,303,622 A * 2/1967 Minds, Jr. ..... 52/473
4,062,522 A 12/1977 Lepetri
4,526,348 A * 7/1985 Cammack ..... 256/65.06
4,962,914 A * 10/1990 Taylor ..... E04H 17/003 256/65.11
5,465,941 A 11/1995 Abbott
5,601,279 A 2/1997 Schwartz et al.
5,810,177 A 9/1998 Cabiran
6,173,944 B1 * 1/2001 McCarthy ..... E04H 17/1443 256/19
6,883,786 B2 * 4/2005 Bebendorf ..... E04H 17/1421 256/19

(Continued)

*Primary Examiner* — Matthieu Setliff
(74) *Attorney, Agent, or Firm* — Vincent J. Allen; Carstens & Cahoon, LLP

(57) ABSTRACT

A modular privacy fence, which includes a stringer having two rails, wherein at least the first rail comprises a plurality of fence picket dividers that protrude in a perpendicular direction from the first rail. The modular privacy fence also includes a fastener attached to the end of the stringer, wherein the fastener is arranged to secure the stringer to a fence post, and a bottom rail with a trough. In some embodiments, the second rail may also include a separate plurality of fence picket dividers that protrude from the second rail in a direction perpendicular to the second rail and parallel to the first plurality of fence picket dividers. In such arrangements, the first plurality of fence picket dividers is offset from the second plurality of fence picket dividers in a direction parallel to the first rail.

13 Claims, 10 Drawing Sheets

(56) References Cited

U.S. PATENT DOCUMENTS

| | | | | |
|---|---|---|---|---|
| 8,317,164 | B2 | 11/2012 | Ash | |
| 8,366,078 | B2 | 2/2013 | Meglino | |
| 2002/0125469 | A1* | 9/2002 | Jones | 256/24 |
| 2004/0079933 | A1 | 4/2004 | Chesnutt | |
| 2005/0194581 | A1 | 9/2005 | Chesnutt | |
| 2011/0233496 | A1 | 9/2011 | Caruso | |
| 2012/0319067 | A1 | 12/2012 | Millar et al. | |

* cited by examiner

MODULAR PRIVACY FENCE WITH INDIVIDUALLY REPLACEABLE PICKETS

CROSS-REFERENCE TO RELATED APPLICATIONS

Not Applicable

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, TABLE, OR COMPUTER PROGRAM LISTING APPENDIX

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

This invention relates in general to hand-constructed barriers, and more particularly to a modular privacy fence with individually replaceable pickets.

2. Description of Related Art

A conventional privacy fence is made of a single row of closely arranged wood pickets that must be specially assembled to match the particular contour and geography of the fenced-in area. Gaps often appear between individual pickets, which can limit the privacy afforded by such a fence. Another disadvantage of such a fence is that the wood pickets deteriorate under continuous exposure to sun, wind, and rain conditions, and often wear unevenly. Such wear can increase the visible gaps between the pickets. When individual fence pickets must be replaced, basic carpentry skills and tools are often required to repair the fence. For example, wood fence pickets are commonly secured in place with staples or nails that must be first removed before installing the new picket. Some fence designs even feature a top rail, which must be removed in order to replace individual pickets.

For increased privacy over single-row picket fences, conventional double-row picket fences are assembled using one or more transverse center rails to which two rows of alternating pickets are nailed or stapled to each side of the center rails. One disadvantage of such a design (beyond the need for basic carpentry skills to assemble one), is that substantial gaps are visible when the fence is viewed at an angle, which reduces the privacy of the fence. Other double-picket or staggered fence designs attempt to improve upon the design by replacing the center rails with a top cap rail, which reduces gaps, but requires special assembly on site.

Metal fences, while more resistant to the abovementioned wear, do not offer the same privacy, security, or aesthetic appeal. Moreover, entirely metal fences are much more costly than wood fences and absorb large amounts of heat during daylight hours, which can make them unsuitable for residential purposes.

SUMMARY

In accordance with one embodiment of the present invention, a modular privacy fence with individually replaceable pickets is provided which substantially eliminates or reduces disadvantages associated with previous systems.

In accordance with another embodiment, a modular privacy fence with individually replaceable pickets is provided, which includes a stringer having two rails, the first rail comprising a plurality of fence picket dividers that protrude in a perpendicular direction from the first rail. The modular privacy fence also includes a fastener attached to the end of the stringer, wherein the fastener is arranged to secure the stringer to a fence post, and a bottom rail with a trough. In particular embodiments, the second rail may also include a separate plurality of fence picket dividers that protrude from the second rail in a direction perpendicular to the second rail and parallel to the first plurality of fence picket dividers. In such arrangements, the first plurality of fence picket dividers is offset from the second plurality of fence picket dividers in a direction parallel to the first rail. In other embodiments, the modular privacy fence may include a compressive fastener that connects the first rail with the second rail, which, when closed, decreases the distance between the first rail and the second rail such that a securing picket divider of the first plurality of fence picket dividers overlaps opposing adjacent picket dividers of the second plurality of fence picket dividers.

In accordance with another embodiment, the second rail of the modular privacy fence instead includes a plurality of gates attached to the ends of some of the fence picket dividers. Each gate may comprise a clasp and a hinge, or each gate may be rotatable about an axis extending from a common picket divider.

One advantage of a modular privacy fence with individually replaceable pickets is the simple manner in which the fence may be assembled without any special tools or carpentry skills on the part of the installer. The modular privacy fence may be arranged to work with commercially available fence pickets that can be purchased from a local hardware store. If an individual picket needs to be replaced, it may be easily removed and another new picket installed in its place without requiring portions of the fence to be disassembled.

Another advantage is the customizable nature of the stringers, which may feature ornamental designs that add to the aesthetic appeal and, therefore, commercial value of the fence.

BRIEF DESCRIPTION OF THE SEVERAL VIEWS OF THE DRAWINGS

For a more complete understanding of the present invention and its advantages, reference is now made to the following description and the accompanying drawings, in which.

DETAILED DESCRIPTION OF THE INVENTION

Figure 1:
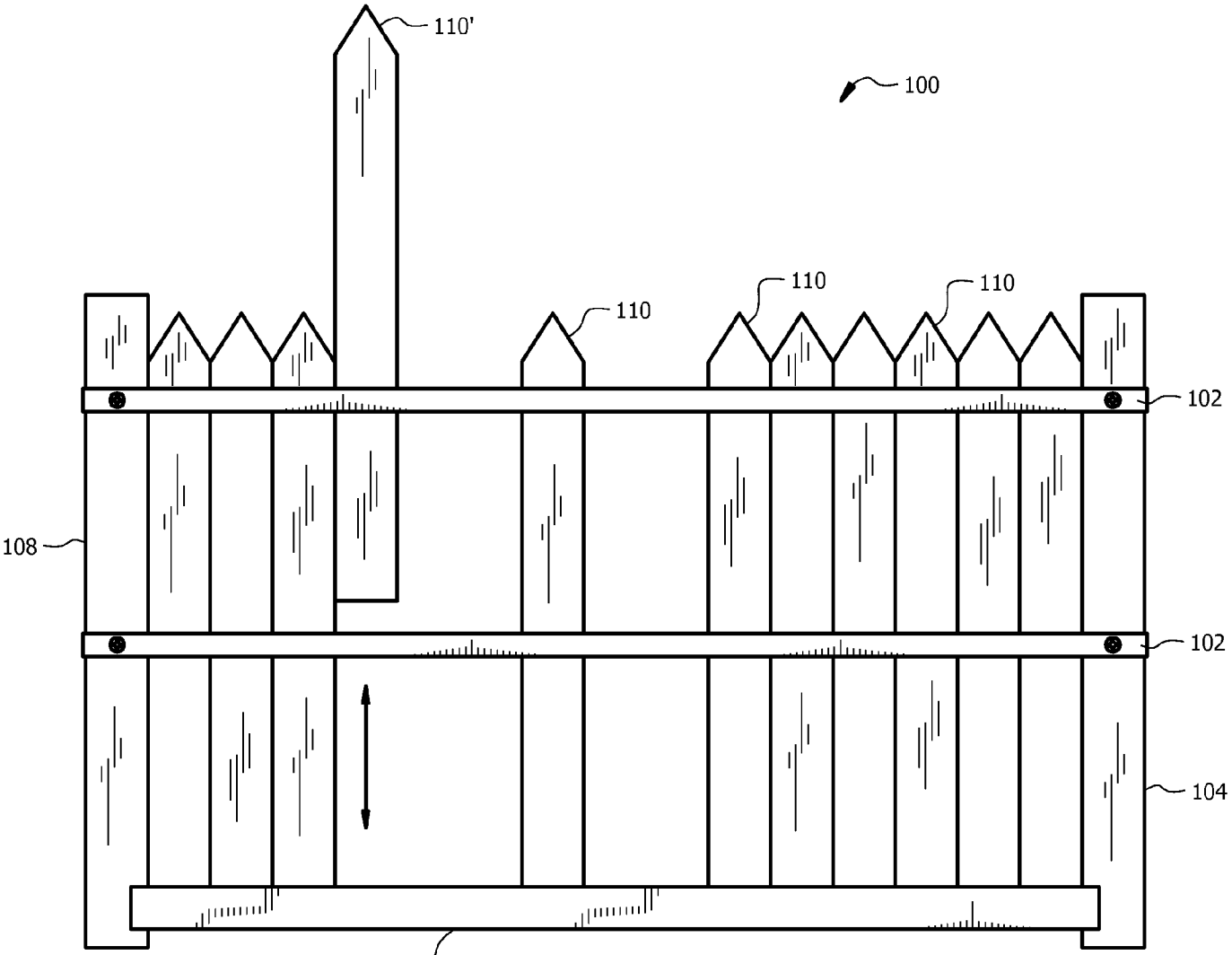
FIG. 1 shows a side view of a modular privacy fence with a single row of fence pickets.

Referring to the drawings, embodiments of the present invention will be described below.

FIG. 1 shows a side view of a modular privacy fence 100 with a single row of fence pickets according to one embodiment. The modular privacy fence 100 is comprised of one or more stringers 102, a bottom rail 106, a pair of fence posts 108, and fence pickets 110. The fence posts 108 may be made of wood, metal, concrete, composite, or any suitably rigid material. Each post 108 may have various shapes in cross-section (e.g., square, circle, etc.). The fence posts 108 will generally be anchored in place by a concrete foundation.

The fence pickets 110 may likewise be made of wood, metal, concrete, composite, or any suitable material. However, the fence pickets 110 are preferably made of wood or composite for aesthetic reasons. The fence pickets 110 may vary in dimension and shape, but will generally have a length corresponding to the desired height of the fence. In preferred embodiments, the modular privacy fence will be configured to work with commercially available wooden pickets, some common dimensions of which are provided in Table 1 below.

TABLE 1

| Length | Width | Depth |
|---|---|---|
| 6' | 3½" | ⅝" |
| 6' | 5½" | ⅝" |
| 6' | 6" | ⅝" |
| 6' | 6" | 1" |
| 8' | 4" | ⅝" |
| 8' | 5½" | ⅝" |
| 8' | 6" | ⅝" |

Of course, fence pickets 110 may also come in other sizes and shapes. For example, a picket 110 to be used with non-privacy alternative embodiment may be much shorter and narrower.

The stringers 102 are used to limit a fence picket's 110 lateral movement. The number of stringers 102 corresponds in general to the height of the fence 100. Taller fences may require more stringers 102 in order to ensure sufficient lateral stability. For example, an eight-foot fence will preferably have at least two stringers. However, the number of stringers 102 may also be increased or decreased for aesthetic or structural reasons. A stringer 102 can be attached to a fence post 108 by any type of suitable connector, including but not limited to: a circumferential bracket and bolt, a transverse bolt that secures a fence post 108 between each side of the stringer 102, slot and tab means, tongue and groove means, welding, etc.

The bottom rail 106 prevents a fence picket 110 from falling through the fence 100. In most embodiments, the bottom rail 106 also provides a level platform that ensures that the fence pickets 110 will have a substantially uniform appearance when installed next to each other. Like a stringer, the bottom rail 106 can be attached to a fence post 108 by any type of suitable connector, including but not limited to: a circumferential bracket and bolt, a transverse bolt that secures a fence post 108 between each side of the stringer 102, slot and tab means, tongue and groove means, welding, etc.

Fence pickets 110 may be installed in the modular privacy fence 100 by sliding a loose fence picket 110' through the stringers 102 until it comes to rest on the bottom rail 106. Unlike many conventional fences with wooden pickets, no additional tools or attachment mechanisms (e.g., staples, nails, glue, or a cap rail) are needed to secure the picket in place according to this particular embodiment. A fence picket 110 may also be slidably removed from the fence 100.

Figure 2A:
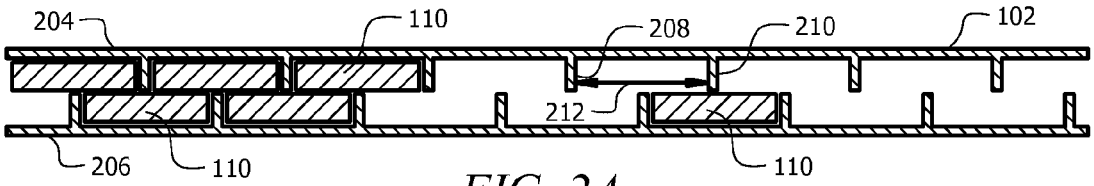
FIGS. 2A and 2B show top and side views (respectively) of a modular privacy fence with a double row of fence pickets.
Figure 2B:
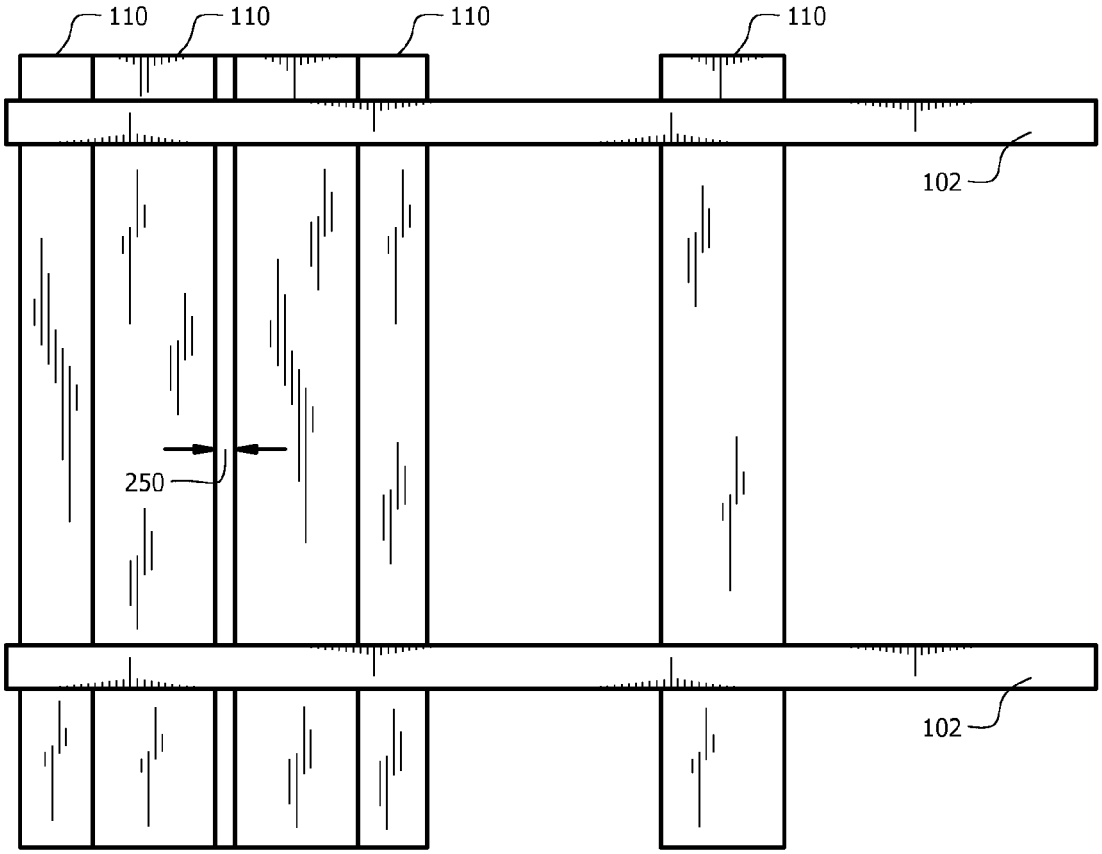

FIGS. 2A and 2B show top and side views (respectively) of a modular privacy fence with a double row of fence pickets. A modular privacy fence 100 may feature different configurations of fence pickets for functional or aesthetic reasons. For example, a double row or fence pickets may provide more privacy and security (less light leakage) than a single row of fence pickets (as illustrated in FIG. 1). Moreover, certain configurations of fence pickets may provide improved sound insulation.

FIG. 2A shows a top view of stringer 102 featuring a double row of pickets according to one embodiment. The stringer 102 has two outer rails (204, 206) that include picket dividers 208 that extend inwardly from the outer rails (204, 206). A fence picket 110 is secured in one direction of motion by two picket dividers (208, 210), which form a picket slot 212. The picket dividers 208 allow pickets 110 to be installed in different patterns. For example, some fence owners who are not concerned with privacy may choose to install only one picket 110 in every other slot (not shown).

The distance between any two picket dividers 208 should be the width of a fence picket 110 plus a small tolerance to allow the picket 110 to be inserted and removed with relative ease. However, the magnitude of the tolerance should be limited (e.g., no more than a few eighths of an inch) to reduce any unintended movement of the fence picket 110 within the picket slot ZZ that might occur. A fence picket 110 may also be secured in a second direction of motion (perpendicular to the first) by an opposing picket divider 210. Since pickets 110 come in different dimensions, it is anticipated that different stringers would be manufactured to accommodate common widths/depths (e.g., 3.5" wide and ⅝-1" deep).

FIG. 2B shows a side view of a modular privacy fence 100 featuring two stringers 102 and with pickets 110 arranged according to the stringer pattern depicted in FIG. 2A (above). The width of the picket divider 208 itself may be varied to produce gaps of varying widths in a row of pickets 110.

Figure 3A:
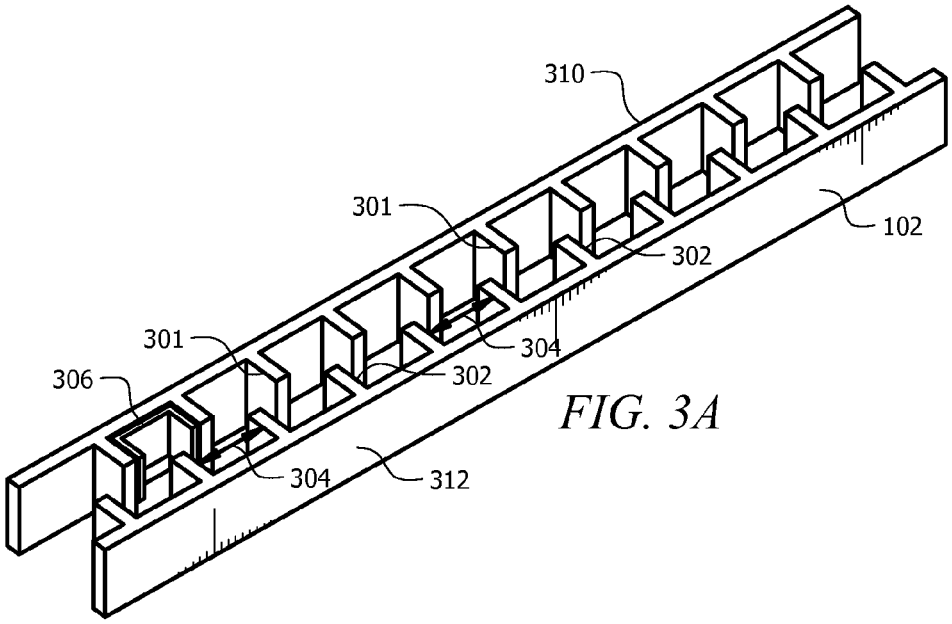
FIGS. 3A and 3B show perspective and top views (respectively) of a double-row stringer according to one embodiment.
Figure 3B:
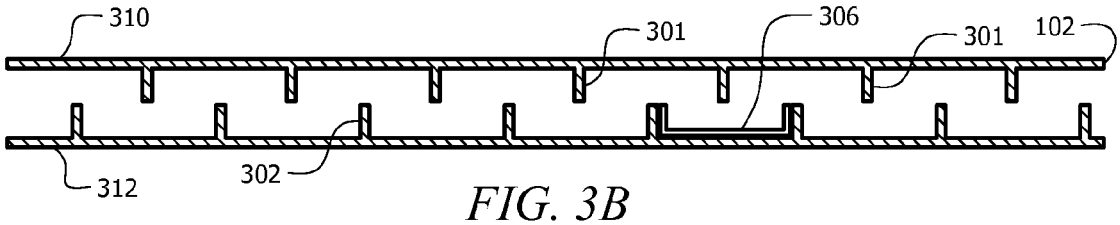

FIGS. 3A and 3B show perspective and top views (respectively) of a double-row stringer according to one embodiment. The double-row stringer 102 comprises outer rails (310, 312), picket dividers (301, 302), and an optional elastomeric insulator 306. In some embodiments, the outer rails (310, 312) may be closed at the ends, or otherwise joined, so as to form a single-bodied stringer 102. In other embodiments, the outer rails (310, 312) may be allowed to move relative to each other so as to permit 'opened' and 'closed' configurations of the stringer 102 (see FIGS. 6A-6E).

The picket dividers (301, 302), which are shown as having the same height as the outer rails (310, 312), may vary in size and shape while still enabling the aforementioned function. The uniformly spaced picket dividers 302 extend inwardly from and perpendicular to the outer rail 310. Opposing picket dividers 301, which form equally sized picket slots 304, are spaced the same distance apart as picket dividers 302 but are offset by a distance. In certain preferred embodiments, picket dividers 301 will be offset such that each picket divider 301 is halfway between two opposing picket dividers 302. The picket dividers (302, 302) will protrude from their corresponding rails 310 by at least ⅛" and, in preferred embodiments, will generally be slightly longer than the depth of a picket 110 (e.g., ⅝"-1") the picket divider is designed to accommodate.

An optional elastomeric insulator 306 may be affixed to the interior surfaces of each of the picket dividers 208. Such elastomeric material 306 reduces excess space that allows lateral picket movement and absorbs any incidental impact from the pickets 110 (i.e., reduces picket jitter from wind) while still permitting pickets 110 to be slidably installed/removed.

In alternative embodiments, the elastomeric insulator 306 may instead by replaced with a tensioning mechanism, such as a bow spring, cantilever spring, or a détente mechanism, positioned on either side of a picket divider (301 or 302), which engages with the sides of an inserted picket 110 so as to provide a closer fit.

For stringers that are made of metal, some may feature any of a variety of finishes (e.g., nickel, gun metal, antique bronze, chrome, satin, etc.). The outer face of the rails (310, 312) may also feature etched ornamental designs (e.g., faux bolt heads, floral patterns, geometric patterns, etc.) to increase the aesthetic appeal. Ornamental designs could be also be configured as separate installable plates that may be affixed to the outer face of a stringer rail via tongue and groove, screws, adhesive, etc.

Figure 4A:
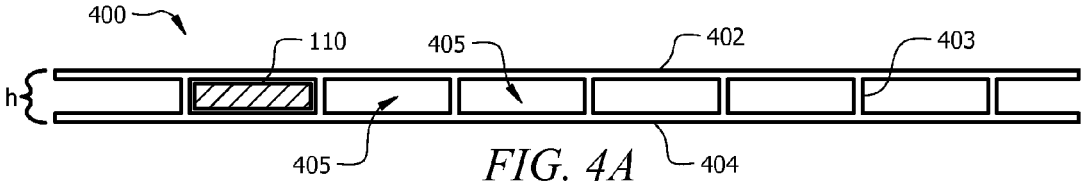
FIG. 4A shows a top view of a single-row stringer according to one embodiment.

FIG. 4A shows a top view of a single-row stringer 400 according to one embodiment. The stringer 400 comprises outer rails (402, 404) and intervening picket dividers 403, which together form an array of slots 405. The height of the slot 405 accommodates a single picket 110. In some embodiments, the picket dividers 403 may be joined to the outer rails (402, 404) by die-cast, welding, extrusion, milling, or any suitable manufacturing method for producing a single body structure. In other embodiments, the stringer 400 may be comprised of an outer rail 402, to which the picket dividers 403 are attached, and a separate second outer rail 404 that may be secured to the first outer rail 402.

Figure 4B:
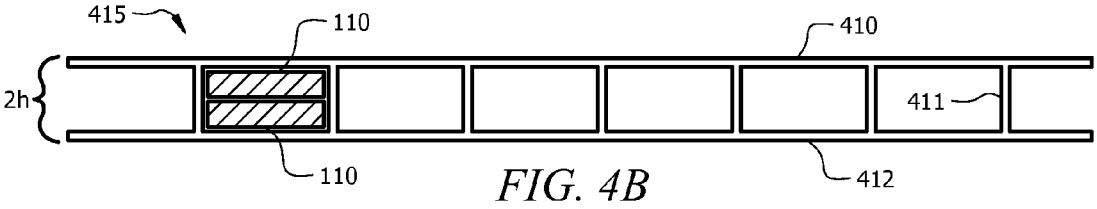
FIG. 4B shows a top view of a double-row stringer according to one embodiment.

FIG. 4B shows a top view of a double-row stringer 415 according to another embodiment. The stringer 415 is arranged in the same manner as stringer 400 except that the width of the resulting structure permits two pickets 110 to pass through the stringer 415 when placed face to face.

Figure 4C:
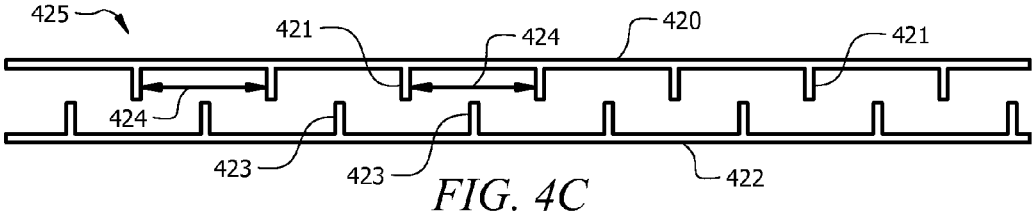
FIG. 4C shows a top view of a double-row stringer according to another embodiment.

FIG. 4C shows a top view of a double-row stringer 425 according to another embodiment. The double-row stringer 425 comprises outer rails (420, 422) and picket dividers (421, 423). In some embodiments, the outer rails (420, 422) may be closed at the ends, or otherwise joined, so as to form a single-bodied stringer. In other embodiments, the outer rails (420, 422) may be allowed to move relative to each other so as to permit 'opened' and 'closed' configurations of the stringer (see FIGS. 6A-6E).

The picket dividers (421, 423), which are shown as having the same height as the outer rails (420, 422), may vary in size and shape while still enabling the aforementioned function. The uniformly spaced picket dividers 423 extend inwardly from and perpendicular to the outer rail 420. Opposing picket dividers 421, which form equally sized picket slots 424, are spaced the same distance apart as picket dividers 423 but are offset by a distance. In certain preferred embodiments, picket dividers 421 will be offset such that each picket divider 301 is halfway between two opposing picket dividers 423.

Figure 4D:
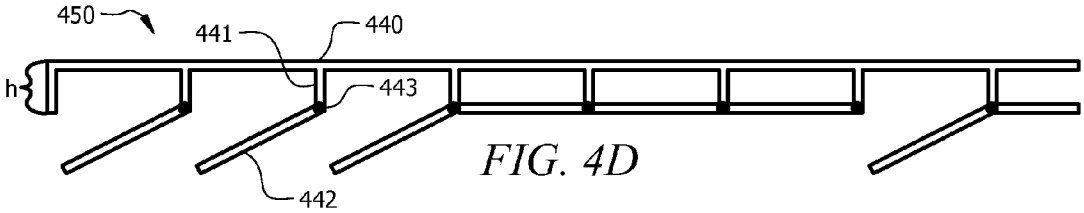
FIGS. 4D and 4E show top and perspective views (respectively) of a gated, single-row stringer according to yet another embodiment.
Figure 4E:
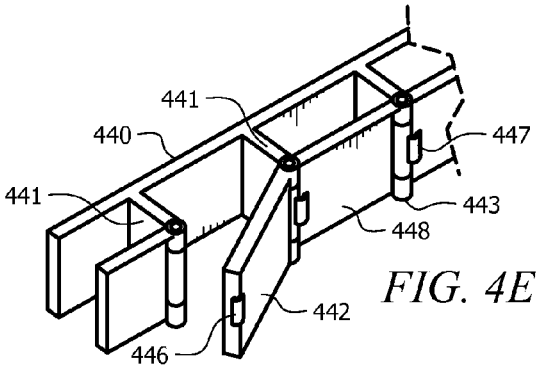

FIGS. 4D and 4E show top and perspective views (respectively) of a gated, single-row stringer 450 according to yet another embodiment. The stringer 450 comprises an outer rail 440, picket dividers 441, and picket gates 442. A picket gate 442 is attached to a corresponding picket divider 441 via a hinge 445, which enables the picket gate 442 to swing open and shut so as to retain a fence picket 110. In some embodiments, the picket gate 442 may be kept in a closed position using a clasp 446. In order to permit a neighboring picket gate 448 (shown closed) to be opened without disturbing the picket gate 442, each picket gate may include an opening 447 near the hinge 445, which is slightly larger than the protruding portion of the clasp 446 so as to permit the clasp 446 to pass through the opening 447.

Figure 5A:
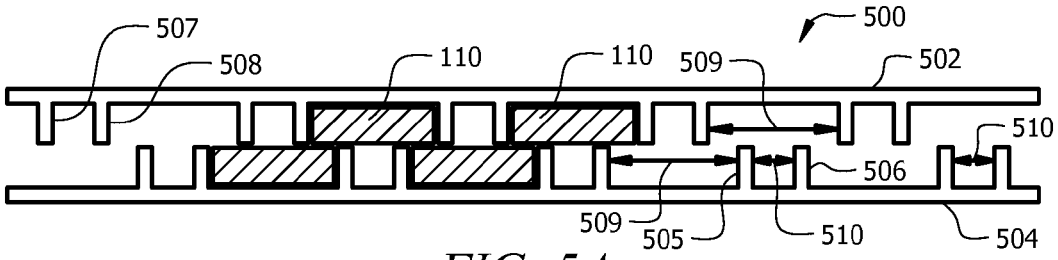
FIGS. 5A, 5B, and 5C show top views of various embodiments of a double-row stringer with picket spacers.
Figure 5B:
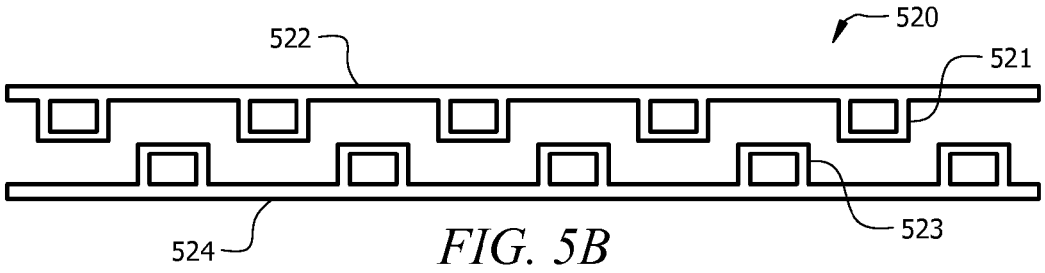
Figure 5C:
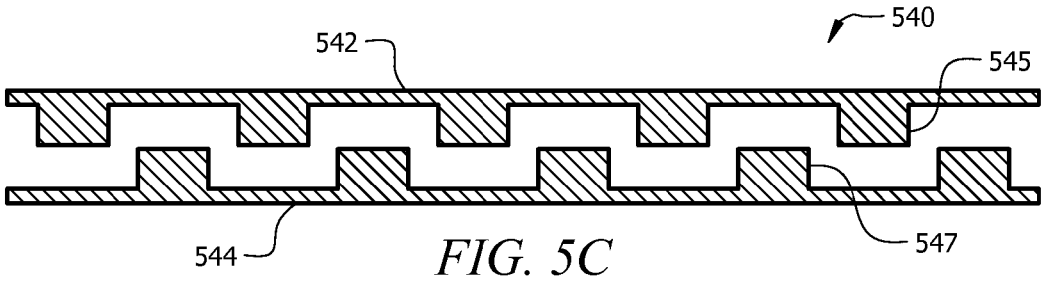

FIGS. 5A, 5B, and 5C show top views of various embodiments of a double-row stringer with picket spacers. FIG. 5A illustrates a stringer 500 that includes outer rails (502, 504), each with left and right picket dividers (505, 506) that form alternating picket slots 509 and picket spacers 510. The spacing and arrangement of the picket dividers (505, 506) depend on the width of the picket 110 that the stringer is designed to accommodate (e.g., see Table 1 above) and the desired spacing between any given picket in a particular row. In preferred embodiments, the width of the picket spacers 510 will be at least ⅛ of an inch wide and no greater than the width of the corresponding picket slots 509 in order to ensure adequate privacy (i.e., no visible gaps in the fence). However, the spacing between pickets may be increased in order to save cost (i.e., the larger the space the less fence pickets that are required to cover a particular fence length) or to achieve a certain design aesthetic.

FIG. 5B shows a top view of a double-row stringer 520 with closed, U-shaped picket spacers (512, 523) according to another embodiment. A U-shaped picket spacer 521 may be cast, formed, milled, welded, or otherwise manufactured or machined to form a three-sided protrusion with substantially flat sides. In preferred embodiments, the height of the U-shaped picket spacers (521, 523) will be at least ⅛ of an inch and will generally not exceed the height of the corresponding outer rail (522, 524). Where material costs are an issue, a U-shaped picket will be less costly than the solid picket spacer depicted in FIG. 5C.

FIG. 5C shows a top view of a double-row stringer 540 with solid picket spacers (545, 547). The solid picket spacers may be made of a single material (e.g., metal) or the spacers (545, 547) may be filled using a fill such as, plastic, resin, composite, rubber, etc. Certain fills with a higher degree of elasticity may reduce the overall resonance of the stringer. Solid picket spacers have the added advantage of having increased yield and impact strength.

Figure 5D:
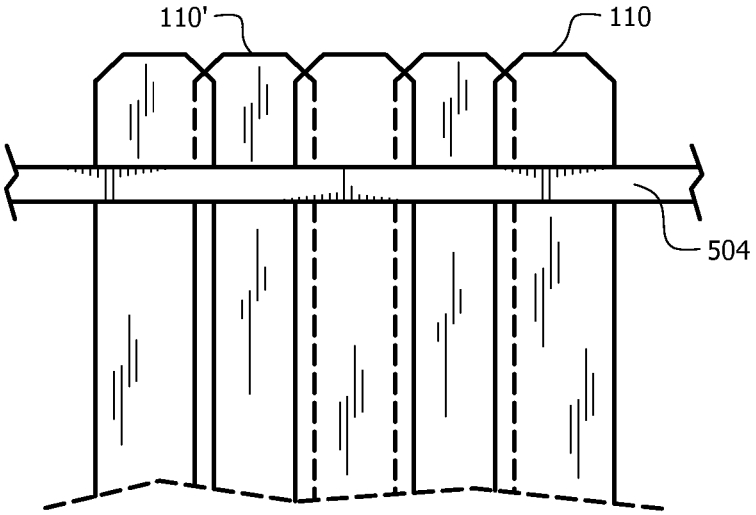
FIG. 5D shows a side view of a modular privacy fence with fence pickets installed using a double-row stringer with picket spacers.
Figure 6A:
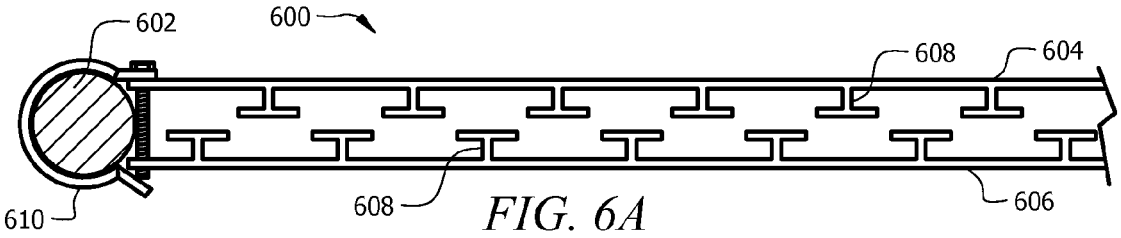
FIGS. 6A-6E show top and perspective views of a clamping stringer attached to a fence post in 'opened' and 'closed' configurations.
Figure 6B:
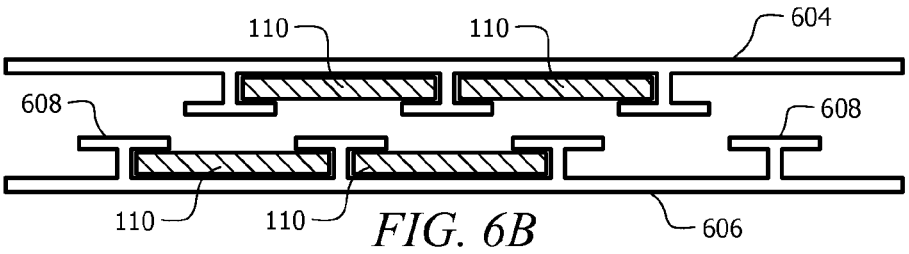
Figure 6C:
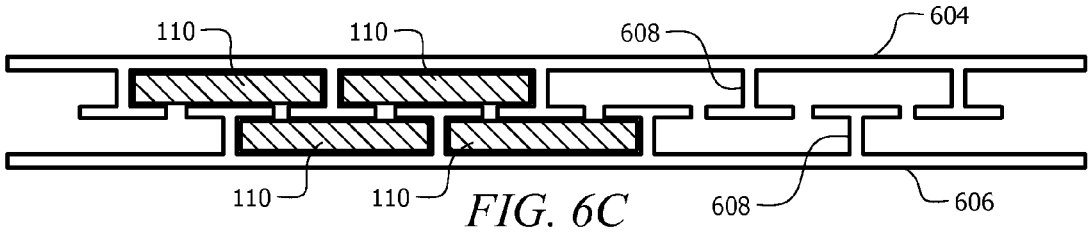
Figure 6D:
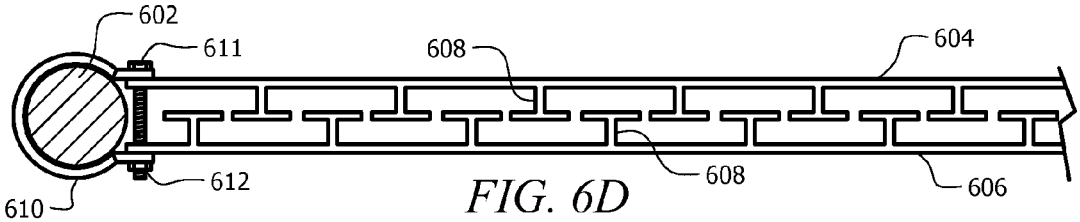
Figure 6E:
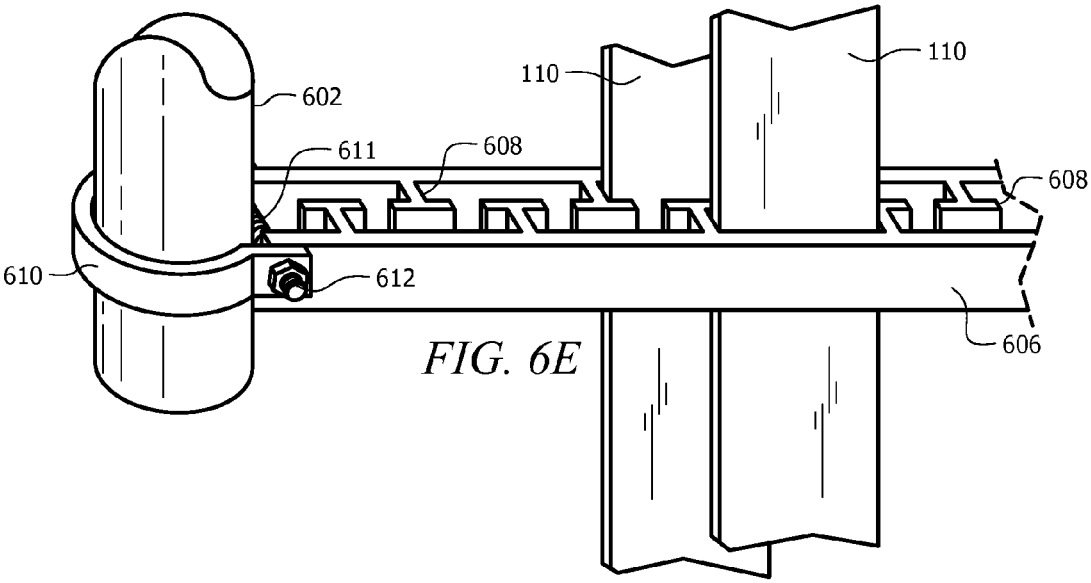

FIG. 5D shows a side view of a modular privacy fence with fence pickets installed using a double-row stringer with picket spacers. As can be immediately envisioned from the figure, the size of the picket spacers impacts the visibility of the second row of fence pickets 110'.

Of course, picket spacers are not limited to use with double-row stringers. In alternative embodiments, a single row stringer may include picket spacers in order to achieve the look of a conventional picket fence, albeit with the consequence of decreased privacy.

FIGS. 6A-6E show top and perspective views of a clamping stringer 600 attached to a fence post in 'opened' and 'closed' configurations. In such an embodiment, the two sides of a stringer may be opened or closed like a clamp in order to install/remove fence pickets. When in an opened configuration (see, e.g., FIGS. 6A and 6B), fence pickets 110 can be slidably inserted between the picket dividers from above. When the stringer is in a closed configuration (i.e., the stringer bars are moved closer together as in FIGS. 6C and 6D), a T-like post from the opposing stringer places pressure on its corresponding picket 110, thus securing it in place. In effect, the two stringer bars provide a jaw-like mechanism that clamps down on any fence pickets that have been inserted into the stringer arrangement. In some embodiments, the inside surface of the stringers and/or the ends of the picket dividers 608 may be given an abrasive finish (e.g., small ridges, points, or a special grit coating) to improve the grip on a fence picket. As an alternative to the T-like picket dividers 608 depicted in FIGS. 6A-6D, other double-row stringer designs, such as those depicted in FIGS. 5A-5C, may also be substituted while achieving the same effect.

The stringers (604, 606) are connected to each other using a fastener which provides the necessary compressive force. For example, the fastener might include a circumferential bracket 610 that is fitted with a bolt 611 that pierces the rails (604, 606) of the stringer and is secured in place with a nut 612. The nut 612 could be tightened to increase the compressive force on the fence pickets 110. Alternatively, a fastener might include a clamp, a pull-action latch clamp, a tie (e.g., rope), or any suitable means for impermanently compressing/decompressing the stringer arrangement. Longer stringer sections might require additional compressive fasteners positioned through the length of the stringer so as to apply an even force throughout.

Figure 7A:
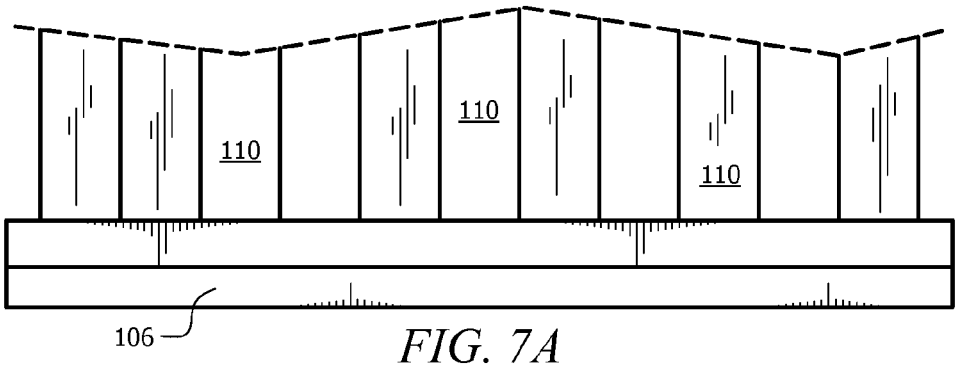
FIGS. 7A, 7B, 7C, and 7D show side, cross-sectional, perspective, and top views (respectively) of a bottom rail.
Figure 7B:
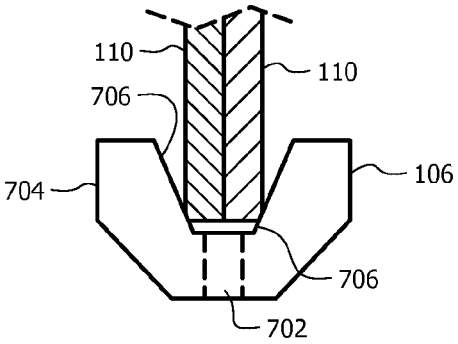
Figure 7C:
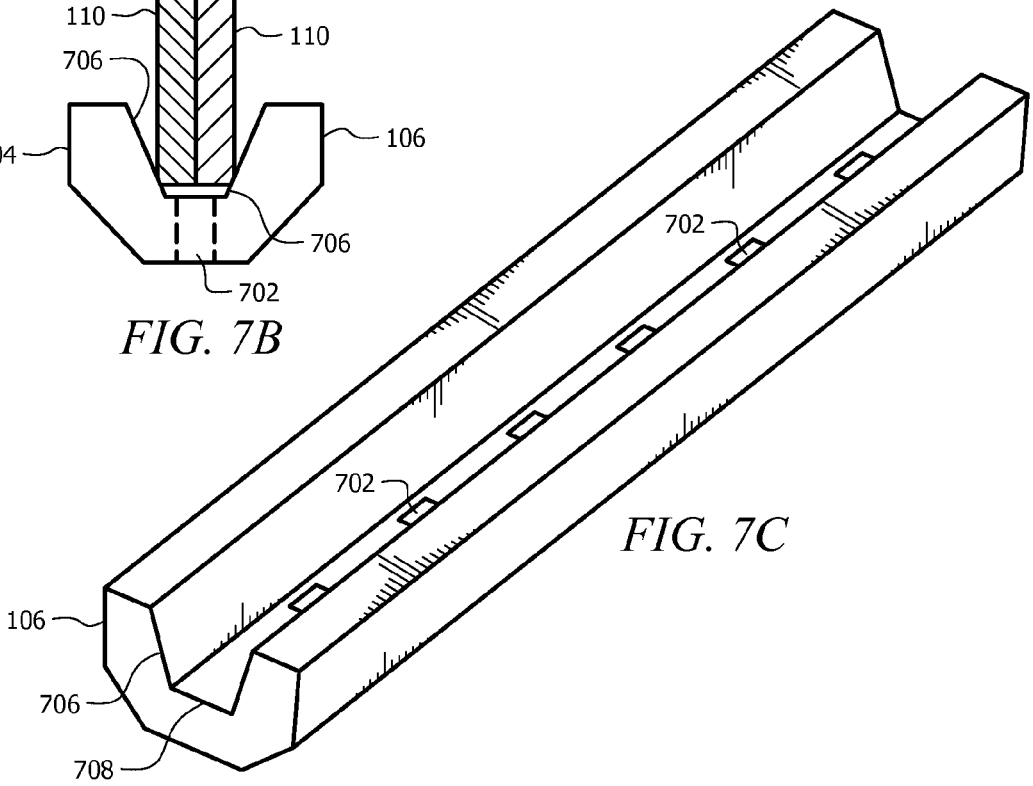
Figure 7D:
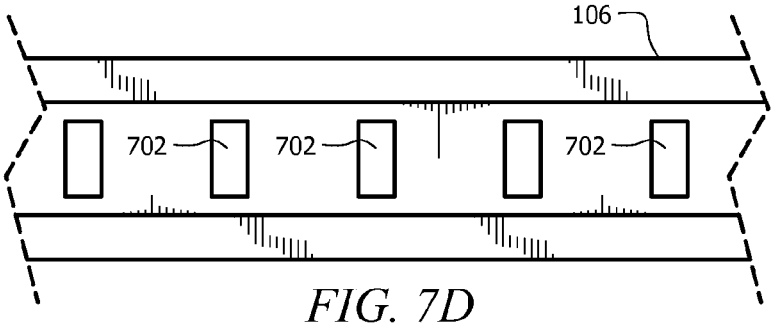

FIGS. 7A, 7B, 7C, and 7D show side, cross-sectional, perspective, and top views (respectively) of a bottom rail. As previously described, a bottom rail 106 is a special type of stringer that prevents a fence picket 110 from falling through the fence 100. A bottom rail may be constructed from wood, metal, composite, or any suitably rigid material. The bottom rail 106 comprises a trough 708 with sides 706 that runs the length of the fence section such that a bottom rail 106 will be substantially the same length as a corresponding stringer 102. In some embodiments (pictured), the sides of the trough 706 may be angled so as to apply a net force along the decline to the picket ends of a double-row fence when pressure is applied to the pickets 110 from above. This has the effect of ensuring a tight fit between facing pickets 110 in the bottom rail 106. As shown in FIGS. 7C and 7D, the bottom rail 106 may also feature drain holes 702 which permit fluids that accumulate in the trough, such as rain water, to drain.

Figure 8A:
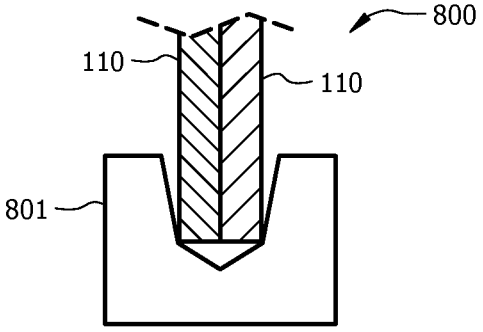
FIGS. 8A-8D show a cross-sectional views of various embodiments of a bottom rail.
Figure 8B:
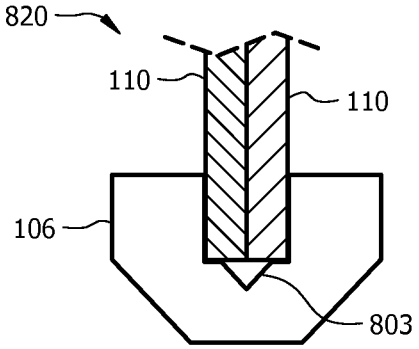
Figure 8C:
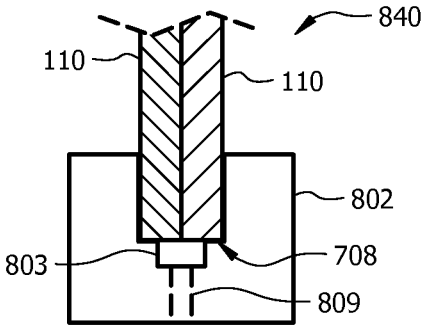
Figure 8D:
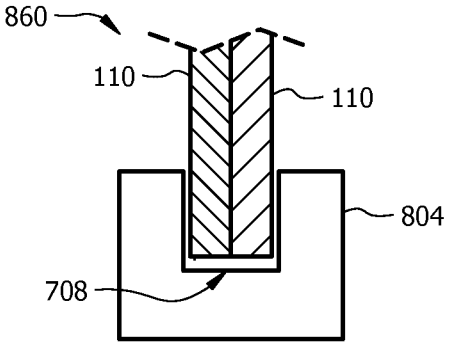

FIGS. 8A-8D illustrate cross-sectional views of various embodiments of a bottom rail 106. As shown, the outer contour of the bottom rail 106 is rectangular or trapezoidal; however, other embodiments may feature curved surfaces or more complex shapes as might be found in crown molding for example. Some bottom rails, such as those depicted in 8B and 8C, may feature a channel 803 in the bottom of the trough 708 that draws water away from the bottom of the fence pickets 110, which may deteriorate or warp if water is drawn into the picket through capillary action. Such a channel may have a slight decline (from the midpoint of the bottom rail) to allow gravity to cause the excess water to run off. As shown in FIG. 8C, the channel may have various shapes to its cross section and may work in conjunction with drain holes 809.

Figure 9:
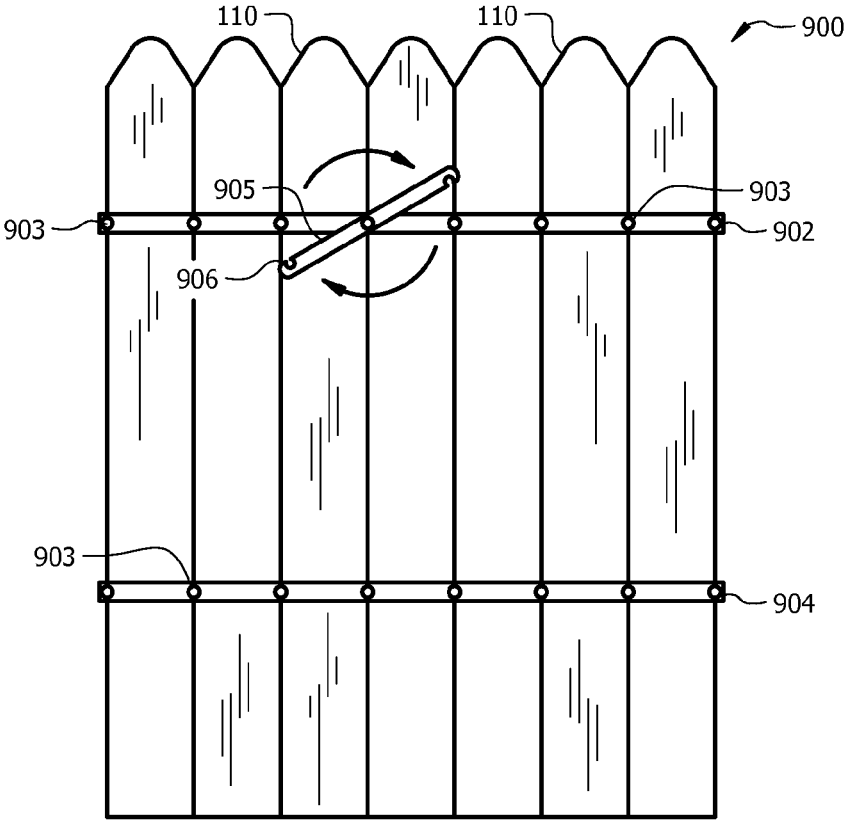
FIG. 9 shows a side view of a modular privacy fence with a gated, single-row stringer according to one embodiment.
Figure 10:
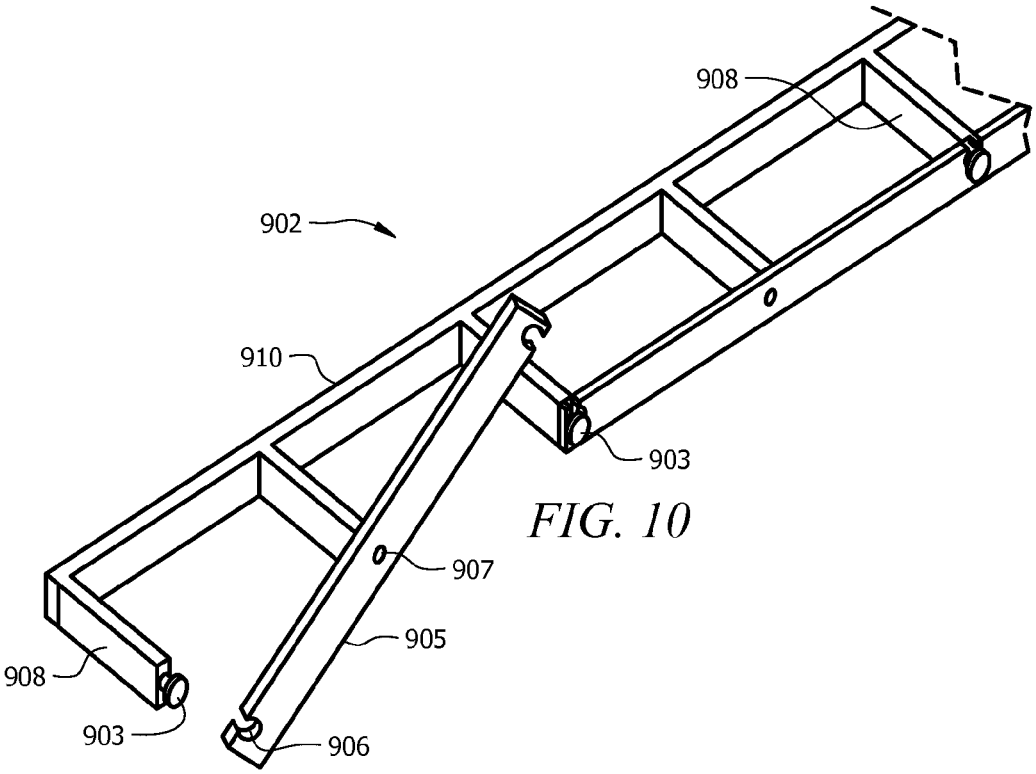
FIG. 10 shows a perspective view of a modular privacy fence with a gated, single-row stringer according to one embodiment.

FIG. 9 shows a side view of a modular privacy fence 900 with a gated, single-row stringer 902 according to one embodiment. FIG. 10 shows the stringer 902 in perspective. The gated stringer 902 includes an outer rail 910 and a plurality of picket dividers 908 with rotatable gates 905. The gate 905 rotates about an axle 907, which extends from a picket divider 908, and locks into place using a hook or catch 906 that mates with posts 903. The gate 905 includes a catch or hook 906 on each end of the gate that are oriented in opposite directions. Each post 903 must accommodate two overlapping catches or hooks 906. One of the ends of each gate might be slightly raised (not pictured) so as to allow it to overlap a neighboring catch when in a locked position. As illustrated in FIG. 9, a fence picket 110 may be installed or removed by rotating the corresponding gate 905 open 90 degrees to its locked position (for each stringer).

I claim:

1. A modular privacy fence, comprising:

a first rail comprising a first plurality of fence picket dividers that protrude in a perpendicular direction from the first rail, wherein each of the first plurality of fence picket dividers comprises a T-shaped cross-section extending in the perpendicular direction from the first rail, wherein a top portion of the T-shaped cross section is parallel to the first rail, and the T-shaped cross-section extends from the first rail a distance that would allow a fence picket to be inserted between two fence picket dividers of the first plurality of fence picket dividers and the top portion of each of the two picket dividers would hold the fence picket in place;

a second rail comprising a second plurality of fence picket dividers that protrude from the second rail in a direction perpendicular to the second rail;

a fastener configured to secure the first rail and the second rail to a fence post, wherein the fastener comprises a compressive fastener that connects the first rail with the second rail, wherein closing the compressive fastener decreases the distance between the first rail and the second rail such that the distal end of a first picket divider of the first plurality of fence picket dividers overlaps the distal end of a second picket divider of the second plurality of fence picket dividers; and a bottom rail having a trough, wherein the bottom rail is positioned at a first end of the fence post, and wherein the first rail and the second rail are positioned substantially near a second end of the fence post, wherein the second end is opposite the first end of the fence post.

2. The modular privacy fence of claim 1, wherein a pair of adjacent fence picket dividers of the first plurality of fence picket dividers is spaced apart by substantially the same width as a fence picket.

3. The modular privacy fence of claim 1, wherein a pair of adjacent fence picket dividers of the first plurality of fence picket dividers forms a picket spacer.

4. The modular privacy fence of claim 1, wherein each of the second plurality of fence picket dividers comprise a T-shaped cross-section extending in the direction perpendicular to the second rail, wherein a top portion of the T-shaped cross section is parallel to the second rail, and the T-shaped cross-section extends from the second rail a distance that would allow a fence picket to be inserted between two fence picket dividers of the second plurality of fence picket dividers and the top portion of each of the two picket dividers would hold the fence picket in place.

5. The modular privacy fence of claim 4, wherein the top portion of each of the first plurality of fence picket dividers and the top portion of each of the second plurality of fence picket dividers line up.

6. A modular privacy fence, comprising:

a plurality of fence pickets;

a stringer having a first rail and a second rail, the first rail comprising a first plurality of fence picket dividers that protrude inwardly from the first rail in a direction perpendicular to the first rail, the second rail comprising a second plurality of fence picket dividers that protrude inwardly from the second rail in a direction perpendicular to the second rail and parallel to the first plurality of fence picket dividers, wherein the first plurality of fence picket dividers is offset from the second plurality of fence picket dividers in a direction parallel to the first rail, wherein a pair of adjacent picket dividers is spaced apart by substantially the same width as a fence picket, and wherein each of the first plurality of fence picket dividers comprises a T-shaped cross-section extending in the perpendicular direction from the first rail, wherein a top portion of the T-shaped cross section is parallel to the first rail, and the T-shaped cross-section extends from the first rail a distance that would allow a fence picket to be inserted between two fence picket dividers of the first plurality of fence picket dividers and the top portion of each of the two picket dividers would hold the fence picket in place;

a bottom rail having a trough, wherein the bottom rail is positioned at a first end of the plurality of fence pickets, wherein the stringer having the first rail and the second rail is positioned substantially near a second end of the plurality of the fence pickets, and wherein the second end is opposite to the first end of the plurality of fence pickets;

a bolt inserted through a first slot in the first rail and inserted through a second slot in the second rail; and a nut threaded to match the bolt, wherein tightening of the nut with respect to the bolt decreases the distance between the first rail and the second rail such that a securing picket divider of the first plurality of fence picket dividers overlaps opposing adjacent picket dividers of the second plurality of fence picket dividers.

7. The modular privacy fence of claim 6, wherein the bottom rail comprises a plurality of drain holes.

8. The modular privacy fence of claim 6, further comprising:

a circumferential bracket having a first slotted end and a second slotted end, wherein the circumferential bracket is configured to connect the stringer to a fence post via the bolt.

9. The modular privacy fence of claim 6, wherein each of the second plurality of fence picket dividers comprise a T-shaped cross-section extending in the direction perpendicular to the second rail, wherein a top portion of the T-shaped cross section is parallel to the second rail, and the T-shaped cross-section extends from the second rail a distance that would allow a fence picket to be inserted between two fence picket dividers of the second plurality of fence picket dividers and the top portion of each of the two picket dividers would hold the fence picket in place.

10. The modular privacy fence of claim 9, wherein the top portion of each of the first plurality of fence picket dividers and the top portion of each of the second plurality of fence picket dividers line up.

11. A modular privacy fence, comprising:

a first post;

a second post separated from the first post, wherein the second post is parallel to the first post;

a transverse stringer attached to the first post and the second post, wherein the stringer comprises a first rail and a second rail forming a plurality of slots arranged in two rows, wherein each slot of the plurality of slots is formed by T-shaped cross-section dividers extending in the perpendicular direction from the first rail, wherein top portions of the T-shaped cross section picket dividers are parallel to the first rail;

a bottom rail attached to the first post and the second post, wherein the bottom rail comprises a trough wherein the bottom rail is positioned at a first location of the first post and at a first location of the second post, wherein the first rail and the second rail are positioned at a second location of the first post spaced apart from the first location of the first post and at a second location of the second post spaced apart from the first location of the second post;

a first row of vertical fence pickets that intersect the stringer via the first row of slots in the plurality of slots, wherein the bottom ends of said pickets rest within the trough of the bottom rail;

a second row of vertical fence pickets that intersect the stringer via the second row of slots in the plurality of slots, wherein the bottom ends of said pickets rest within the trough of the bottom rail, and wherein the first row of vertical fence pickets and the second row of vertical fence pickets form a plurality of vertical fence pickets; and a fastener that connects the first rail to the second rail, wherein the decompression of the fastener with respect to the transverse stringer permits a fence picket of the plurality of vertical fence pickets to be slidably inserted into a slot of the plurality of slots, and wherein the compression of the fastener with respect to the transverse stringer prevents the fence picket of the plurality of vertical fence pickets from being removed from the stringer.

12. The modular privacy fence of claim 11, wherein the fastener is a bolt that is inserted through a first slot in the first rail and a second slot in the second rail and secured with a nut.

13. The modular privacy fence of claim 11, wherein the plurality of slots is arranged in two staggered rows.

* * * * *